US008015831B2

(12) United States Patent
Bellis et al.

(10) Patent No.: US 8,015,831 B2
(45) Date of Patent: Sep. 13, 2011

(54) CRYOCOOLER SPLIT FLEXURE SUSPENSION SYSTEM AND METHOD

(75) Inventors: Lowell A. Bellis, Long Beach, CA (US); Robert C. Hon, Playa del Rey, CA (US)

(73) Assignee: Raytheon Company, Waltham, MA (US)

( * ) Notice: Subject to any disclaimer, the term of this patent is extended or adjusted under 35 U.S.C. 154(b) by 1154 days.

(21) Appl. No.: 11/803,926

(22) Filed: May 16, 2007

(65) Prior Publication Data

US 2008/0282708 A1 Nov. 20, 2008

(51) Int. Cl.
*F25B 9/00* (2006.01)

(52) U.S. Cl. ..... 62/6; 60/517

(58) Field of Classification Search ..... None
See application file for complete search history.

(56) References Cited

U.S. PATENT DOCUMENTS 4,227,100 A * 10/1980 Ezekiel et al. ..... 310/13
4,397,155 A * 8/1983 Davey ..... 62/6
5,351,490 A * 10/1994 Ohishi et al. ..... 62/6
5,647,217 A * 7/1997 Penswick et al. ..... 62/6
5,743,091 A * 4/1998 Penswick et al. ..... 60/517
5,920,133 A * 7/1999 Penswick et al. ..... 310/17
6,050,556 A * 4/2000 Masuda et al. ..... 267/161
6,094,912 A * 8/2000 Williford ..... 60/520
6,167,707 B1 1/2001 Price et al.
2004/0093873 A1* 5/2004 Ogura ..... 62/6
2004/0163388 A1* 8/2004 Yamagiri et al. ..... 60/517
2004/0221576 A1* 11/2004 Lynch et al. ..... 60/517
2006/0156741 A1* 7/2006 Kirkconnell et al. ..... 62/6

* cited by examiner

*Primary Examiner* — Frantz F Jules
*Assistant Examiner* — Lukas Baldridge
(74) *Attorney, Agent, or Firm* — Pillsbury Winthrop Shaw Pittman LLP

(57) ABSTRACT

A cryocooler in which two independently moving flexure systems are split across a single magnetic structure, decreasing package size and increasing resistance to cantilevered mass sag due to external forces. A series of concentrically oriented flexure coupling shafts are provided that allow two independently moving flexure assemblies to be split across a single motor. A series of connectors are included on the forward side of the motor that pass through the outer shaft and allow the inner connecting shaft to be mounted to its flexures without interference. A series of close-out connections are included on the aft flexure stacks that makes assembly possible, providing firm mechanical connections without interference.

22 Claims, 5 Drawing Sheets

FIG. 1
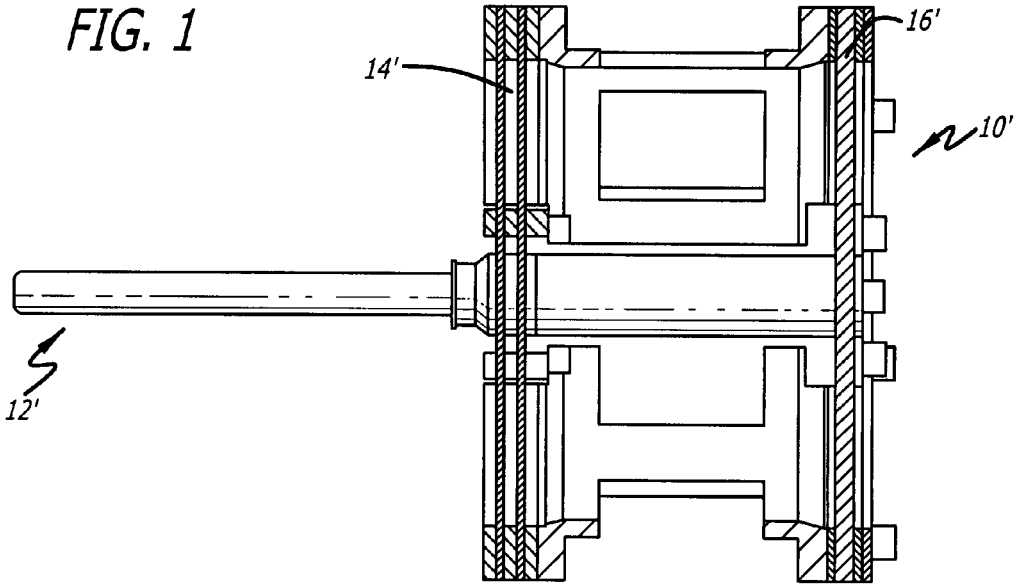
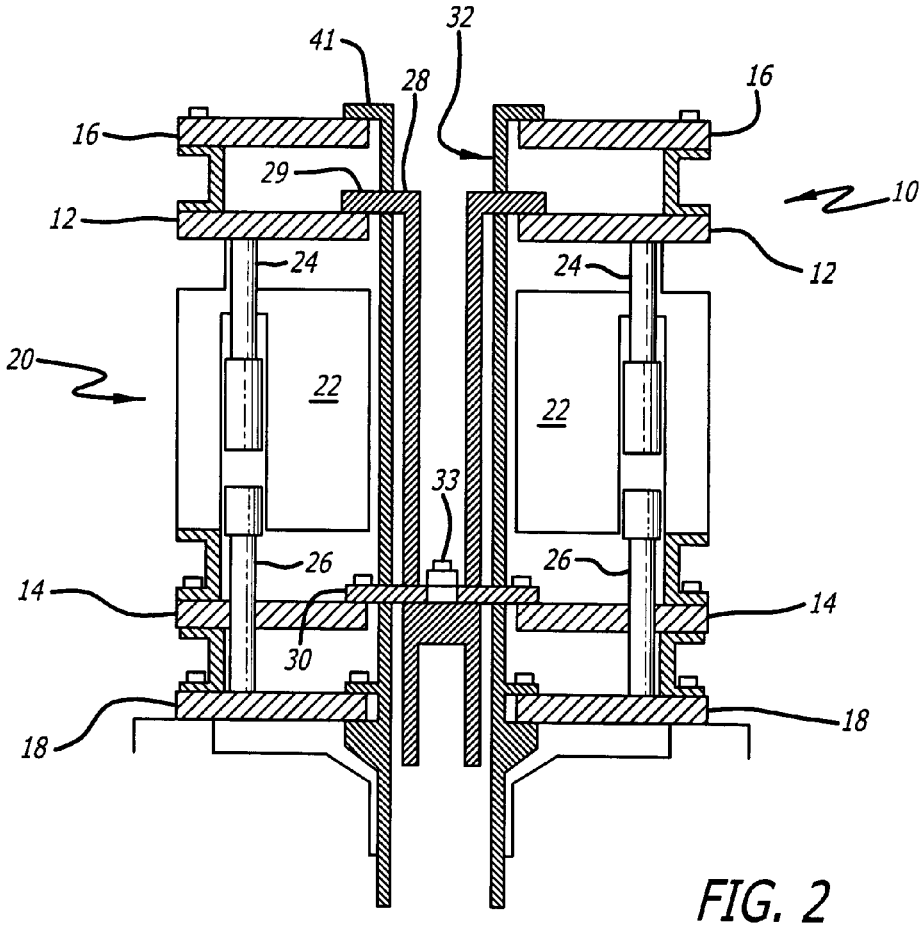
FIG. 2

CRYOCOOLER SPLIT FLEXURE SUSPENSION SYSTEM AND METHOD

BACKGROUND OF THE INVENTION

1. Field of the Invention

The present invention relates to cryogenic coolers. More specifically, the present invention relates to systems and methods for suspending and supporting cryogenic coolers.

2. Description of the Related Art

Space infrared sensor systems often require use of a cryogenic cooling subsystem to achieve increased sensor performance. Numerous types of cryogenic cooling subsystems exist, each having relatively strong and weak attributes compared to the other types. Certain space cryocoolers typically have efficiency, operational flexibility and vibration performance as strong suits. However, these strengths come at the cost of increased mass and volume relative to other available systems.

For example, the application of flexure-borne moving assemblies is one of the most important developments in modern cryocoolers because the associated high amounts of radial stiffness allow for close-tolerance non-contacting clearance seals to be used in place of traditional rubbing seals. This has resulted in a large increase in cryocooler lifetimes because the use of non-contacting clearance seals avoids the numerous contamination and degeneration issues associated with rubbing seals. The benefit of using flexure-borne moving assemblies therefore depends on the flexure system's ability to keep the moving parts properly centered in their clearance seals during operation and as external side-load forces are applied (for instance during spacecraft launch).

The mechanical realities associated with cryocooler clearance seal design dictate that some portion of the moving system's mass will be cantilevered away from the flexure system itself. Cantilevered masses are inherently more prone to sag due to externally-applied forces and measures must be taken to prevent this from happening For example, a novel feature being proposed for the design of inline Stirling cryocoolers involves the use of a single magnetic structure to drive both the compressor and Stirling displacer pistons. In this configuration, flexure suspension systems for both the compressor and displacer pistons must be oriented in some way around the single magnetic structure.

Traditionally, the compressor suspension would be placed completely on one side of the magnetic circuit of the cryocooler, with the displacer suspension being located completely on the opposite side. Significant portions of the compressor and expander moving masses would be cantilevered away from the suspension elements. In this configuration, the individual flexure stacks in each suspension subassembly must be spaced apart in order to provide sufficient radial stiffness such that the cantilevered masses (of the compressor and expander moving elements) do not sag as side-load forces are applied. Spacing the flexures increases the effective mechanical advantage of the flexures in the radial direction.

However, this arrangement is extremely inefficient from a packaging standpoint. Specifically, the flexures on each side of the motor must be spaced a significant distance apart in order to reduce sag of the cantilevered pistons. This spacing between flexure stacks adds significant length to the overall design.

Hence, a need remains in the art for a system or method for sufficiently suspending moving elements of a system such as a cryocooler while minimizing required package volume and mass.

SUMMARY OF THE INVENTION

The need in the art is addressed by the suspension system of the present invention. In the illustrative embodiment, the inventive system is adapted for use with a first element mounted to translate along a first longitudinal axis and includes a first mechanism coupled to the element at a first end thereof for maintaining alignment of the element; a second mechanism for maintaining alignment of the element, the second mechanism being disposed at a second end of the element such that the element is largely positioned between the first and second mechanism. A third mechanism is included for mechanically coupling the first mechanism to the second mechanism.

In the illustrative embodiment, the first mechanism is a first flexure stack, the second mechanism is a second flexure stack and the third mechanism is a tube. In more specific embodiments, a second element is included adapted to translate along the-first longitudinal axis. The second element is disposed at least partially between the first and the second mechanisms. A fourth mechanism is coupled to the second element at a first end thereof for maintaining alignment of the element. A fifth mechanism is included for maintaining alignment of the second element. The fifth mechanism being disposed at a second end of the second element such that the second element is largely positioned between the fourth and fifth mechanisms. A sixth mechanism mechanically couples the fourth mechanism to the fifth mechanism. The fourth mechanism is a third flexure stack and the fifth mechanism is a fourth flexure stack. The sixth mechanism is coaxial with the third mechanism.

In the illustrative application, the third mechanism is part of a compressor and the sixth mechanism is part of a Stirling displacer. The compressor and displacer are driven by coils that are mounted within a magnetic field of a magnetic circuit.

In the illustrative embodiment, two independently moving flexure systems, each consisting of two discrete flexure stacks separated by an appropriate distance, are split across a single magnetic structure, decreasing package size and greatly increasing resistance to cantilevered mass sag due to external forces. A series of concentrically oriented flexure connecting shafts are provided that allow two independently moving flexure assemblies to be split across a single motor. A series of connectors are included on the forward side of the motor that pass through the outer shaft and allow the inner connecting shaft to be mounted to its flexures without interference. A series of close-out connections are included on the aft flexure stacks that makes assembly possible, providing firm mechanical connections without interference.

Essentially, this invention allows the normally unused space between the two flexure stacks of each flexure system to be occupied by the cryocooler motor's magnetic circuit; little unused volume is necessary for the spacing of the flexures, allowing for a reduction of package size while maintaining the mechanical advantage necessary to prevent sag of cantilevered masses. The invention can be assembled and aligned at a lower level of integration as compared to typical Stirling cryocooler mechanisms with an alignment procedure that offers inherent simplicity, accuracy, and stability.

BRIEF DESCRIPTION OF THE DRAWINGS

FIG. 1 is a sectional side view of a cryocooler with a suspension system with two flexure stacks in accordance with conventional teachings.

FIG. 2 is a simplified sectional side view of a suspension system in accordance with an illustrative embodiment of the present teachings.

DESCRIPTION OF THE INVENTION

Figure 3:
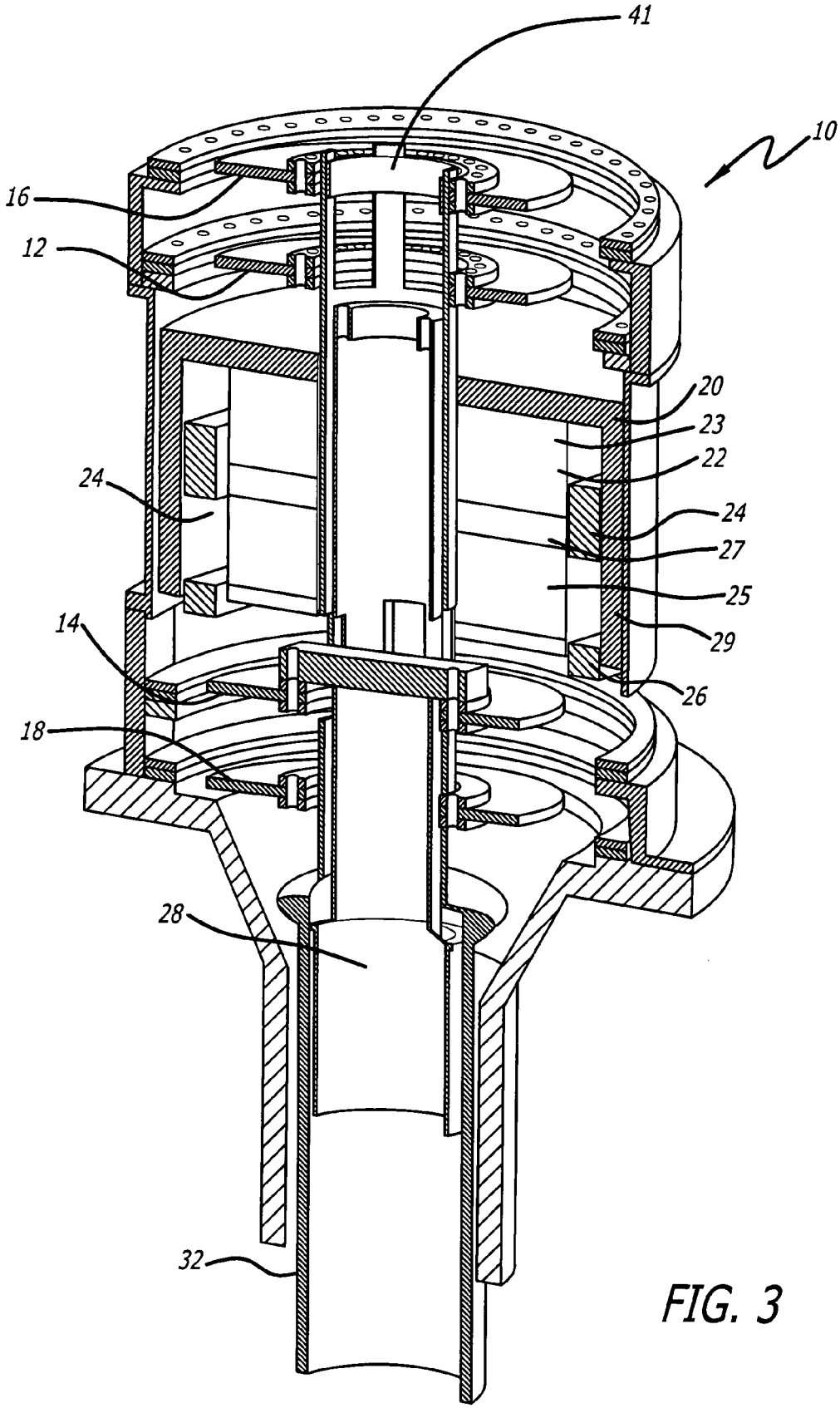
FIG. 3 is a sectional perspective view of the motor and suspension system of FIG. 2 in more detail.

Illustrative embodiments and exemplary applications will now be described with reference to the accompanying drawings to disclose the advantageous teachings of the present invention.

While the present invention is described herein with reference to illustrative embodiments for particular applications, it should be understood that the invention is not limited thereto. Those having ordinary skill in the art and access to the teachings provided herein will recognize additional modifications, applications, and embodiments within the scope thereof and additional fields in which the present invention would be of significant utility.

U.S. patent application Ser. No. 11/805,320, filed May 16, 2007 by R. C. Hon et al. and entitled STIRLING CYCLE CRYOGENIC COOLER WITH DUAL COIL SINGLE MAGNETIC CIRCUIT MOTOR, the teachings of which are incorporated herein by reference, discloses and claims a novel and advantageous dual-coil, single magnetic circuit Stirling cryocooler design that is a departure from convention in that a single motor is used to drive two independently-moving assemblies.

This invention provides a system and method for splitting two independent flexure systems, such as could be used to mechanically support the compressor and Stirling Displacer moving elements as described in the above-referenced patent application, across a single motor, specifically addressing the complications that arise from routing two connection shafts through the central axis bore of a single magnetic circuit. At the most basic level the design consists of two hollow support tubes arranged one concentric inside of the other. Novel flexure attachment features are required to connect the inner tube (and to a lesser degree the outer tube) to its particular flexure stacks.

As mentioned above, traditionally, the compressor suspension arrangement would be placed completely on one side of the magnetic circuit of the cryocooler, with displacer suspension being located completely on the opposite side. This typical method is to suspend each moving assembly from two sets of flexures ("flexure stacks") with some amount of spacing between them. This is illustrated in FIG. 1 for a single compressor piston.

FIG. 1 is a sectional side view of a cryocooler compressor piston with a suspension system with two flexure stacks in accordance with conventional teachings. In this system 10', the individual flexure stacks 14' and 16' in each suspension subassembly must be spaced apart in order to provide sufficient radial stiffness such that the cantilevered masses, such as the piston 12', do not deflect, deform or sag as side-load forces are applied.

The minimal amount of distance between the flexure stacks is determined by the radial stiffness of the individual flexure stacks, the actual amount of cantilevered mass, and the allowable radial deflection within the relevant clearance seal and under relevant amounts of side-loading. In effect, the moving assembly 12' acts as a lever arm, with the flexure stack 14' closest to the cantilevered mass acting as a fulcrum. The radial stiffness of the flexure stack 16', most distant from the cantilevered mass 12', is effectively increased through the mechanical advantage provided by the lever arm and fulcrum. Hence, the greater the distance between flexure stacks, the greater the resistance to sag of the unsupported end of cantilevered mass 12'.

Those skilled in the art will appreciate that while increased distance between flexure stacks is advantageous from-the perspective of sag resistance, it is a distinct disadvantage from the standpoint of packaging because the distance between flexures manifests as added length to the overall package. While it is fairly straightforward to place the magnetic circuit between the flexures of a single moving element, it is considerably less obvious how to accomplish this when two moving elements (and hence two separate flexure suspension systems) are present.

The present teachings provide a method to mitigate this additional required length by placing the drive motor magnetics inside of the volume between flexure stacks. This is illustrated in FIG. 2.

FIG. 2 is a simplified sectional side view of a suspension system in accordance with an illustrative embodiment of the present teachings. As shown in FIG. 2, the cryocooler 10 includes two flexure systems 12/14 and 16/18, each split across of motor 20. The motor 20 includes a magnetic circuit 22, a compressor coil and bobbin assembly 24 and a displacer coil and bobbin assembly 26 of design and construction as described in the above-reference patent application. Those skilled in the art will appreciate that the present teachings are not limited to the arrangement shown or to the use of compressor and/or displacer coils. The present teachings are applicable in any system in which there is a need to stabilize multiple elements adapted to move along a first axis against motion around or along other axes.

In FIG. 2, first and second conventional flexure stacks 12 and 14 are disposed on opposite sides of the motor and connected with a first shaft tube 28 that is routed through a hole in the central (longitudinal) axis of the motor 20. The first shaft tube 28 is connected to the second stack 14 via a connecting element 30. A second shaft tube 32 couples the third flexure stack 18 on one side of the motor to the fourth flexure stack 16 on the opposite side of the motor. The second and fourth flexure stacks 14 and 18 are 'forward' flexure stacks and the first and third flexure stacks 12 and 16 are 'aft' flexure stacks. These designations serve to distinguish the two sides of the magnetic circuit. The forward flexure stacks lie between the magnetic assembly and the thermodynamic section of the cryocooler 10.

The fourth flexure stack 18' connects to the outer support tube 32 (a Stirling Displacer in the illustrative embodiment) with a standard bolted interface. The second-flexure stack 14 connects to the inner support tube 28 (a Stirling Compressor in the illustrative embodiment) through use of a series of stackable flexure clamps or connecting elements 30. As discussed more fully below, these elements pass through the outer Stirling displacer support tube 32 via access slots 40 that are cut into the outer tube. The connecting elements attach to the inner support tube 28 by way of a single socket head cap screw 33 that is installed through the open rear of the support tubes. In one mode, this screw 33 is injectable so that the entire stackable clamp/screw/support tube assembly can be epoxy set and stabilized. Other options exist for fastening the connecting elements. The magnetic assembly (motor) 20 contains a bore on its central (longitudinal) axis to accommodate both support tubes.

The aft compressor flexure stack 12' occupies the space directly behind the magnetic assembly and connects to the inner support tube 28 by a hub that presents radial spokes that mate to the inner bolt circle of the compressor flexure stack. This radially spoked feature can be implemented in at least two ways. The first option integrates the spoked feature with the compressor support tube and the two are machined as a single piece. This design is only applicable if the magnetic circuit center bore is large enough so that the spoked features can pass through it as the magnetic assembly is slid over the support tubes.

An alternate design makes the spoked feature a separate entity that is mounted to the compressor support tube after the magnetic assembly is installed over the two support tubes. This would be useful if the magnetic design requires a smaller bore to achieve sufficient magnetic performance. In this case, a threaded retainer ring can be used to firmly clamp the spoked part to the compressor support tube.

In either case, the spoked features are used to secure the support tube to the inner bolt circle of the aft compressor flexure assembly.

As disclosed more fully below, the outer expander support tube 32 is slotted to accommodate-passage of the spoked features as the inner compressor support tube 28 is inserted inside of the expander tube. The remaining aft flexure stack 16 attaches to the rear of the outer expander support tube via an intermediary part 41 as show in FIG. 3 that is installed onto the tube after all of the other flexure stacks are assembled. This part presents features that engage and fill the aforementioned slots in the expander support tube. Once the part is mounted, it provides a bolt circle to secure the inner hole pattern of the aft flexure stack to the expander support tube. The inner flexure bolt circle can then be attached to the expander support tube. A more detailed assembly and alignment procedure is attached below.

The components of the cryocooler 10, with the exception of the connecting elements 30, are largely annular in shape. The flexure stacks are of conventional design and construction. In the illustrative embodiment, the first and second shafts or tubes are concentric and constructed with titanium or other suitable material.

FIG. 3 is a sectional perspective view of the motor and suspension system of FIG. 2 in more detail. As illustrated in FIG. 3, the magnetic circuit 22 of the motor 20 includes first and second permanent magnets 23 and 25, separated by a center pole 27 disposed within a backiron 29.

Figure 4B:
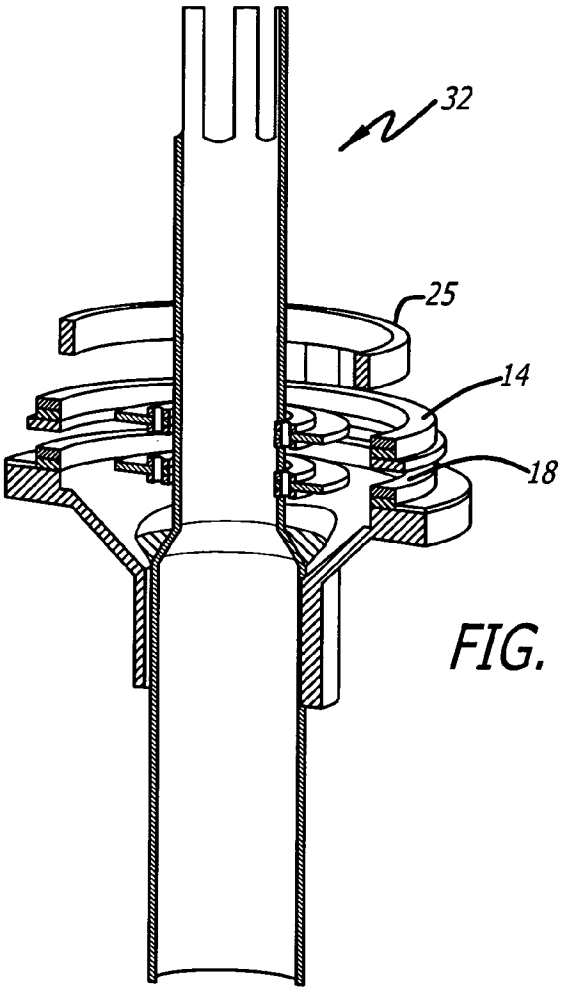
FIG. 4*b* is an elevated perspective side view partially in section of the shaft tubes, motor coil and flexures of the suspension system of the illustrative embodiment.
Figure 4A:
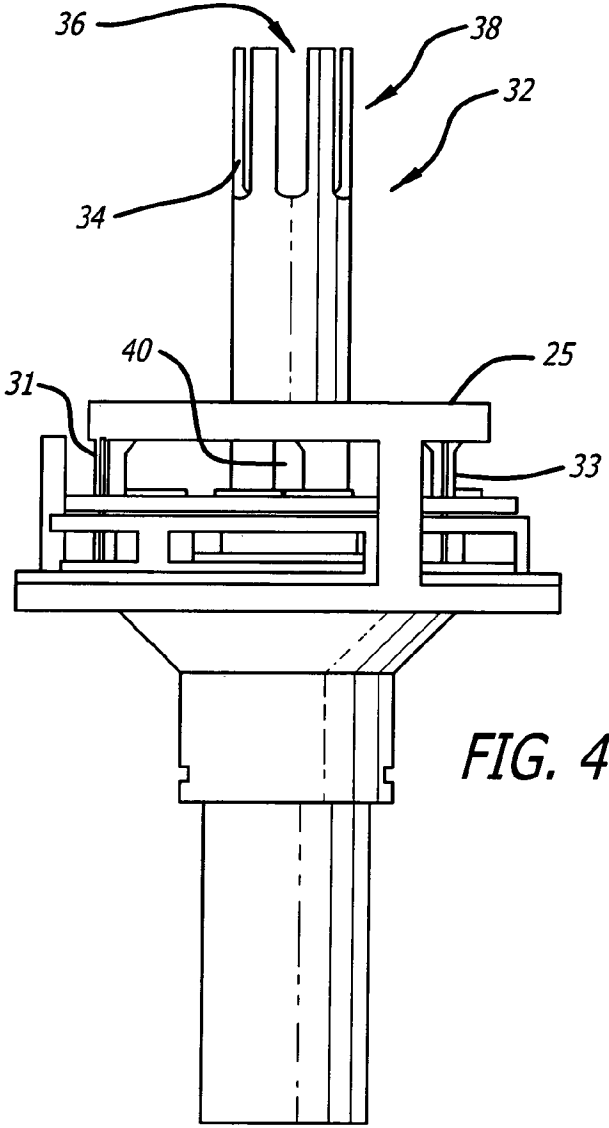
FIG. 4*a* is an elevated perspective side view of the shaft tubes, motor coil and flexures of the system of the illustrative embodiment.

FIG. 4*a* is a partial elevated perspective side view of the shaft tubes, motor coil and flexures of the suspension system of the illustrative embodiment. Note the provision of slots 34, 36, 38 and 40 in the outer shaft tube 32. The upper slots 34, 36 and 38 allow for the spokes 29 of the inner shaft tube 28 to connect with the first flexure stack 12 while the lower slots of which only one 40 is shown, allow for the connecting elements 30 to couple motion from the inner shaft tube 28 to the second flexure stack 14. In addition, the elongate slots 34, 36, 38 and 40 along the longitudinal axis of the shaft tube 32 allow for relative rotation of the inner and outer shaft tubes about the longitudinal axis as may be required by flexure mechanics.

Also shown in FIG. 4*a* is a bobbin and coil assembly 25 for the Stirling Displacer motor coil. The bobbin has three standoffs of which two 31 and 33 are shown.

FIG. 4*b* is a partial elevated perspective side view partially in section of the shaft tubes, motor coil and flexures of the suspension system of the illustrative embodiment. The second flexure stack 14 connects to the inner shaft tube 28 (not shown) in this view. The fourth flexure stack 18 connects to the outer shaft tube 32.

Figure 4C:
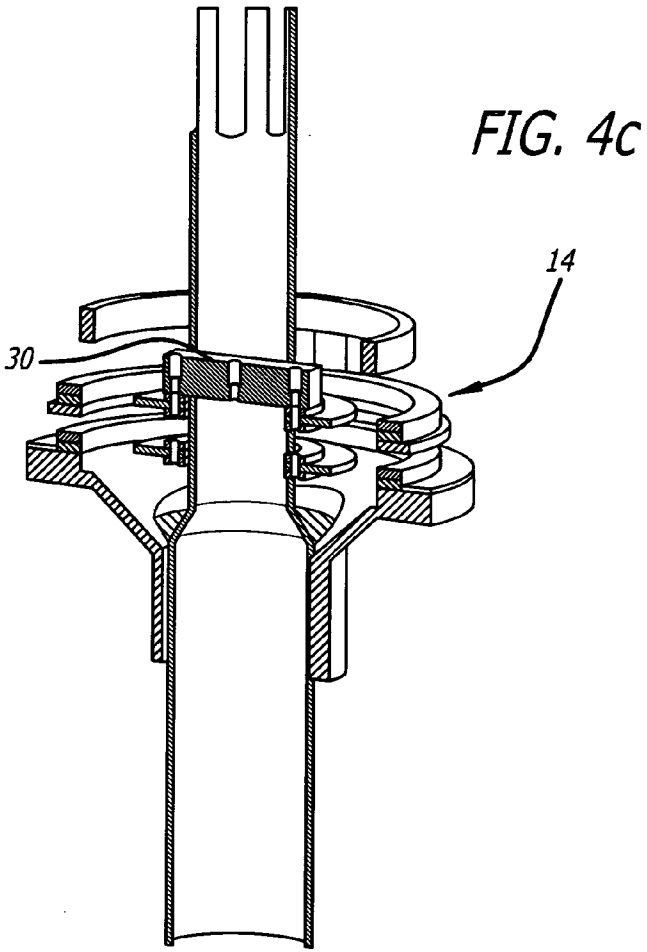
FIG. 4*c* is an elevated sectional side view of the shaft tubes motor coil and flexures of the suspension system of the illustrative embodiment.

FIG. 4*c* is a partial elevated sectional side view of the shaft tubes, motor coil and flexures of the suspension system of the illustrative embodiment. FIG. 4*c* shows the connecting element 30 used to couple the inner shaft tube 28 to the second flexure stack 14. Note that FIGS. 4*a, b*, and *c* do not include any aft suspension components for clarity.

Figure 5:
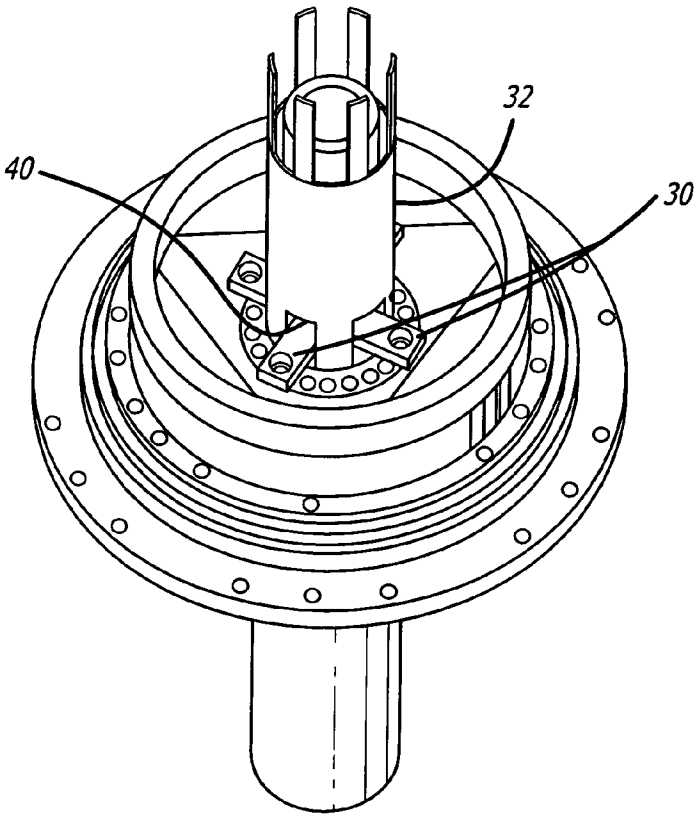
FIG. 5 is a partial perspective end view of the shaft and flexures of the suspension system with the housing, flexure stacks, motor cage and motor coils removed for clarity.

FIG. 5 is a partial perspective end view of the shaft and flexures of the suspension system with the housing, aft flexure stacks, motor cage and compressor motor coils removed for clarity. FIG. 5 shows how the connecting elements 30 extend through the lower slots (e.g. 40) in the outer shaft tube 32 to connect the inner shaft tube 28 to the second flexure stack 14.

Figure 6:
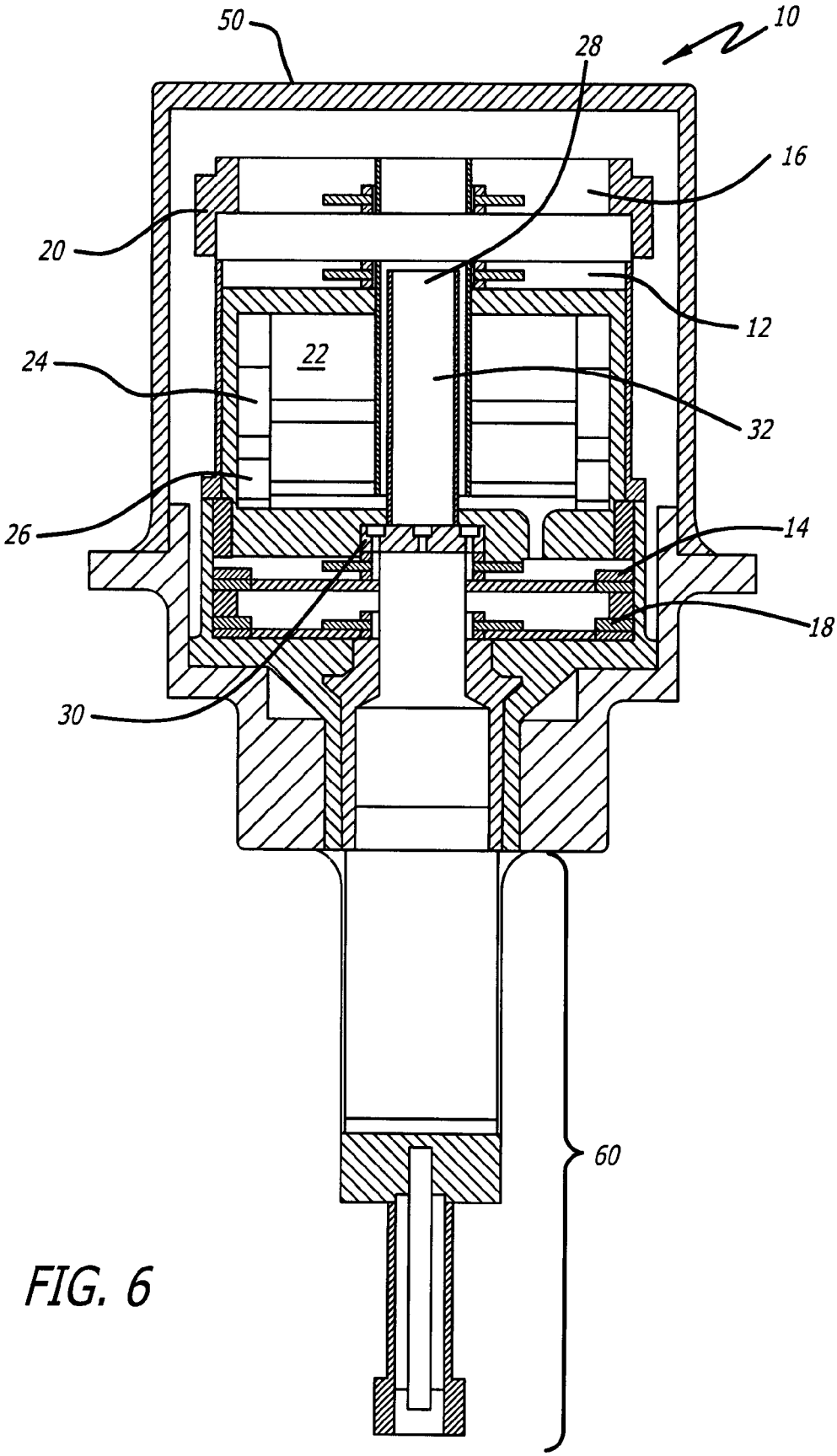
FIG. 6 is a sectional side view of a complete cooling system in accordance with an illustrative embodiment of the present teachings.

FIG. 6 is a sectional side view of a complete cooling system in accordance with an illustrative embodiment of the present teachings. As shown in FIG. 6, the system 10 includes a housing 50 within which the motor 20 is disposed. Within the motor 20 is a magnetic circuit 22 with which the compressor and expander motor coils 24 and 26 interact via the magnetic flux thereof. As discussed above, the compressor coil 24 connects to the first flexure stack 12 while the expander coil 26 connects to the fourth flexure stack 18. The first flexure stack 12 is connected to the second flexure stack 14 for stability via the inner tube 28. The fourth flexure stack 18 is connected to the third flexure stack 16 for stability by the outer shaft tube 32. A cold head 60 is provided at the end of the housing 50.

In summary, the present invention provides a system and method for splitting two independently moving flexure suspension systems across a single magnetic circuit. The mechanical design for connecting the appropriate flexure stacks to each other across the magnetic circuit allows for a substantial reduction in overall package size when implemented in accordance with the present teachings.

Thus, the present invention has been described herein with reference to a particular embodiment for a particular application. Those having ordinary skill in the art and access to the present teachings will recognize additional modifications applications and embodiments within the scope thereof.

It is therefore intended by the appended claims to cover any and all such applications, modifications, and embodiments within the scope of the present invention.

Accordingly,

What is claimed is:

1. A Stirling cryocooler comprising:

a magnetic circuit;

a compressor coil disposed within the magnetic field of said circuit, said coil being adapted to translate along a first longitudinal axis;

a first flexure stack coupled to one side of said compressor coil;

a second flexure stack disposed on an opposing side of said compressor coil such that said compressor coil is positioned between said first and second flexure stacks;

a mechanical coupling between said first flexure stack and said second flexure stack;

a third flexure stack and a fourth flexure stack longitudinally separated from each other so as to contain the first and second flexure stacks therebetween;

a displacer coil adapted to translate along said first longitudinal axis;

wherein said displacer coil is disposed between said first and said second flexure stacks;

wherein the fourth flexure stack is coupled to said displacer coil at a first end thereof; and wherein the third flexure stack is disposed at a second end of said displacer coil such that said displacer coil is positioned between said third and fourth flexure stacks.

2. The cryocooler of claim 1 further including a mechanical coupling between said third flexure stack and said fourth flexure stack.

3. The cryocooler of claim 2, wherein the mechanical coupling between the first and second flexure stacks is coaxial with the mechanical coupling between the third and fourth flexure stacks.

4. A suspension method for use with a first element adapted to translate along a first longitudinal axis, said method comprising:

providing a first flexure stack on one side of said first element so as to maintain alignment of said first element;

providing a second flexure stack on an opposing end of said element so as to maintain alignment of said first element, said second flexure stack and said first flexure stack being arranged such that said first element is partially or wholly positioned between said first and second flexure stacks;

mechanically coupling said first flexure stack and said second flexure stack;

providing a third flexure stack and a fourth flexure stack on opposite sides of said first and second flexure stacks so as to contain the first and second flexure stacks therebetween;

a displacer coil adapted to translate along said first longitudinal axis;

wherein said displacer coil is disposed between said first and said second flexure stacks;

wherein the fourth flexure stack is coupled to said displacer coil at a first end thereof; and wherein the third flexure stack is disposed at a second end of said displacer coil such that said displacer coil is positioned between said third and fourth flexure stacks.

5. A suspension system for a first element adapted to translate along a first longitudinal axis, said system comprising:

a first flexure stack coupled to said first element at a first end thereof and arranged to maintain alignment of said first element;

a second flexure stack that maintains alignment of said first element, said second flexure stack being disposed at an opposing end of said first element such that said first element is positioned between said first and second flexure stacks;

a mechanical coupler that connects said first flexure stack to said second flexure stack;

a third flexure stack and a fourth flexure stack longitudinally separated from each other so as to contain the first and second flexure stacks therebetween;

a displacer coil adapted to translate along said first longitudinal axis;

wherein said displacer coil is disposed between said first and said second flexure stacks;

wherein the fourth flexure stack is coupled to said displacer coil at a first end thereof; and wherein the third flexure stack is disposed at a second end of said displacer coil such that said displacer coil is positioned between said third and fourth flexure stacks.

6. The system of claim 5, wherein the mechanical coupler is a tube.

7. The system of claim 5, wherein the mechanical coupler is coupled to the first element.

8. The system of claim 5, wherein the mechanical coupler is coupled to the first flexure stack via spokes.

9. The system of claim 5, further comprising a second element adapted to translate along the first longitudinal axis.

10. The system of claim 9, wherein the second element is disposed between the first and second flexure stacks.

11. The system of claim 9, wherein the fourth flexure stack is coupled to the second element at a first end thereof so as to maintain alignment of the second element.

12. The system of claim 11, wherein the third flexure stack is disposed at an opposing end of the second element such that the second element is positioned between the third and fourth flexure stacks.

13. The system of claim 9, further comprising a tubular coupler that is coupled to the second element.

14. The system of claim 5, further comprising a tubular coupler that couples the third flexure stack to the fourth flexure stack.

15. The system of claim 14, wherein the tubular coupler is at least a portion of a Stirling displacer piston.

16. The system of claim 14, wherein the tubular coupler is coupled to a displacer piston.

17. The system of claim 14, wherein the mechanical coupler is received within the tubular coupler.

18. The system of claim 14, wherein the mechanical coupler is coaxial with the tubular coupler.

19. The system of claim 14, wherein the mechanical coupler comprises spokes at one end thereof, and wherein the tubular coupler comprises a first set of slots constructed and arranged to receive the spokes of the mechanical coupler when the mechanical coupler is received within the tubular coupler.

20. The system of claim 19, wherein the tubular coupler comprises a second set of slots constructed and arranged to receive connecting elements that connects the mechanical coupler to the second flexure stack.

21. The system of claim 5, wherein the mechanical coupler is at least a portion of a compressor piston.

22. The system of claim 5, wherein the mechanical coupler is coupled to the compressor piston.

* * * * *